United States Patent [19]

Iwamoto et al.

[11] Patent Number: 4,961,663

[45] Date of Patent: Oct. 9, 1990

[54] CARTRIDGE TYPE COSMETIC BAR CONTAINER

[75] Inventors: Yoichi Iwamoto, Chiba; Hisao Iwamoto, Kanagawa, both of Japan

[73] Assignee: Kanebo, Ltd., Tokyo, Japan

[21] Appl. No.: 434,753

[22] Filed: Nov. 13, 1989

[51] Int. Cl.[5] ..... A45D 40/06

[52] U.S. Cl. ..... 401/78; 401/86; 401/DIG. 1

[58] Field of Search ..... 401/78, 77, 75, 80, 401/86

[56] References Cited

U.S. PATENT DOCUMENTS

| | | | |
|---|---|---|---|
| 2,529,673 | 11/1950 | Blake | 401/78 |
| 3,146,881 | 9/1964 | Metreaud | 401/75 |
| 3,991,775 | 11/1976 | Spatz | 401/78 |
| 4,505,607 | 3/1985 | Sugiyama | 401/78 |
| 4,666,324 | 5/1987 | Oses | 401/78 |
| 4,884,912 | 12/1989 | Gueret | 401/86 |

*Primary Examiner*—Richard J. Johnson
*Attorney, Agent, or Firm*—Armstrong, Nikaido, Marmelstein, Kubovcik & Murray

[57] ABSTRACT

This invention relates to a cartridge type cosmetic bar container removably accommodating a cartridge of lipstick or the like in a rotary operating cylinder. This container is designed for an extended useful life, greater ease of use and simplified construction.

In the cartridge type cosmetic bar container of this invention, the outer bottom of the inner cylinder of the cartridge is provided with a recess engageable with a cylindrical elevation provided at the inner bottom of the rotary operating cylinder, whereby the inner cylinder and rotary operating cylinder are joined as a unit. As the user turns the rotary operating cylinder, the inner cylinder is rotated and consequently the payout cylinder accommodated in the inner cylinder ascends or descends.

3 Claims, 8 Drawing Sheets

CARTRIDGE TYPE COSMETIC BAR CONTAINER

BACKGROUND OF THE INVENTION

1. Field of the Invention

The present invention relates to a cartridge type cosmetic bar container comprising a cartridge holding a cosmetic bar such as a lipstick and a cylindrical housing adapted to exchangeably accommodate said cartridge and rotatable to pay out said cosmetic bar.

2. Brief Description of the Prior Art

The container for a bar-shaped cosmetic product such as a lipstick generally comprises a bottomed cylinder and a shiftable cylinder movably disposed therein, with a lipstick or the like being held in said shiftable cylinder so that it can be shifted out and in through a top opening of said bottomed cylinder. Since this container and the lipstick are supplied as a unit, the container must be discarded after consumption of the lipstick. Moreover, it is impossible to exchange lipsticks only, with the container being unchanged. Therefore, there has recently been developed a cartridged cosmetic bar product comprising a structurally simple, inexpensive cartridge holding a cosmetic bar and a capped rotatable cylinder case which accepts said cartridge as separable units. With this container, upon consumption of the lipstick, the cartridge is taken out from the rotatable cylinder and discarded and a new cartridge is installed therein instead, thus permitting reuse of the rotatable cylinder case. Since the cartridge is simple in construction and inexpensive, this cosmetic bar product is less costly than the earlier product. Furthermore, this cartridged cosmetic bar product has the advantage that by providing a plurality of cartridges holding different kinds of lipsticks, the desired lipstick can be selectively used by changing the cartridge only.

A typical example of the above cartridge type cosmetic bar container is disclosed in Japanese laidopen Utility Model Application No. 63-64312/1988. As illustrated in FIG. 10, this container comprises a cartridge 51 and a rotatable cylinder 53 having a cap 52, which is adapted to removably accommodate said cartridge 51 therein. The cartridge 51 mentioned just above comprises an inner cylinder 56 having a peripheral wall 54 provided with an axially extending elongated slot 55, an outer cylinder 58 having a spiral groove 57 on its inner circumferential wall and rotatably sleeved over the outer periphery of said inner cylinder 56, and a payout cylinder 60 rotatably accommodated in said inner cylinder 56 with a projection 59 on its outer peripheral surface being engaged with said spiral groove 57 of outer cylinder 58 through said elongated slot 55 of inner cylinder 56. The peripheral groove 61 of inner cylinder 56 and the peripheral ridge 62 of outer cylinder serve to rotatably install the inner cylinder 56 within the outer cylinder 58. The rotatable cylinder 53 having the cap 52 is a bottomed cylinder and adapted to removably accommodate said cartridge 51. This cartridge type cosmetic bar container discharges its function as follows. As the above-mentioned rotatable cylinder 53 is rotated, the torque drives the inner cylinder 56 to turn, whereupon the payout cylinder 60 ascends or descends along the elongated slot 55. In this container, the driving torque of the rotatable cylinder 53 is transmitted to the inner cylinder 56 by the following mechanism. Thus, the outer peripheral surface of the lower part of said inner cylinder 56 is provided with a plurality of longitudinal grooves 63 at circumferentially spaced intervals and an engaging groove 64 below said longitudinal grooves 63 and as shown in FIG. 12, a built-in cylinder 67 having resilient engaging projections 65 and ridges 66 engaging said longitudinal grooves 63 is disposed in said rotatable cylinder 53. Indicated at 68 is a cutout. The lower part of said inner cylinder 56 is fitted into said built-in cylinder 67, with said engaging grooves 64 being engaged with said resilient projections 65, and as illustrated in FIG. 11, a given one of said plurality of longitudinal grooves 63 being engaged with an engaging ridge 66 so as to transmit the torque of the rotatable cylinder 53 to the inner cylinder 56 via said engaging ridges 66 and longitudinal grooves 63. The engaging grooves 64 and resilient ridges 65 serve to preclude dislodging of the rotatable cylinder 53 from the inner cylinder 56.

However, the above torque transmission mechanism has the follow ing disadvantages. Thus, in inserting the lower part of said inner cylinder 56 into the built-in cylinder 67 of the rotatable cylinder 53, the four ridges 66 disposed circumferentially at ¼ pitches on the outer periphery of the built-in cylinder 67 must be exactly engaged with the plurality of longitudinal grooves 63 disposed on the outer periphery of the inner cylinder 56 at its lower part. However, it is difficult to confirm the above engagerent and there may be a case in which the engaging ridge 66 rides on the area between the corresponding longitudinal groove 63 and adjoining longitudinal groove 63 and if the container is used in this condition for a long time, the height of the engaging ridge 66 is decreased by fatigue. In that event, when a fresh cartridge 51 is set upon consumption of the initial cartridge, with its longitudinal grooves 63 being brought into engagement with the ridges 66 of the built-in cylinder 67, the decreased height of the ridge 66 results in the formation of a gap between that ridge 66 and the longitudinal groove 63 due to failure of contact. If the rotatable cylinder 53 is turned in this condition, the engaging ridge 66 may ride over the longitudinal groove 63 onto the area between two adjacent longitudinal grooves 63,63. Even in this condition, the torque of the rotatable cylinder 53 will be transmitted to the inner cylinder 56. However, if this condition persists, the height of the engaging ridge 66 is further decreased and, as a result, the ridge 66 even fails to contact the area between longitudinal grooves 63,63 so that the torque of the rotatable cylinder 53 is no longer transmitted to the inner cylinder 56. As a consequence, the reuse of the rotatable cylinder 53 is made impossible, thus shortening the useful life of the container.

To alleviate this disadvantage, it has been proposed to reduce the rotational friction between the outer cylinder 58 and inner cylinder 56 so that the inner cylinder 56 may be turned even if the torque transmitted from the rotatable cylinder 56 is small. However, since the rotational force to be applied to the rotatable cylinder 53 need not be large in such construction, even a slight force causes the inner cylinder 56 to turn and, hence, the lipstick to ascend or descend too easily. If the inner cylinder 56 is turned even by such a very slight force, no adequate resistance is felt by the user so that the manipulability of the container is rather adversely affected. Furthermore, the above construction has a further disadvantage in that if the cosmetic bar, e.g. a lipstick, is paid out to a given length of exposure and applied forcefully against the lip or the like, the force applied causes the inner cylinder 56 to turn in the reverse direction and, hence, the lipstick to descend back. A still further disadvantage of the above construction is that it is complicated in structure and, therefore, its manufacture takes much time and labor.

SUMMARY OF THE INVENTION

The object of the present invention is to provide a cartridge type cosmetic bar container which permits reuse of the rotatable cylinder, insures an. optimum manipulating force so that even when the cosmetic bar, e.g. a lipstick, is pressed forcefully against the lip or the like, the cosmetic bar is not driven back, and is simple in construction.

To accomplish the above-mentioned object, the cartridge type cosmetic bar container according to the present invention comprises a cartridge comprising a bottomed inner cylinder with a peripheral wall having an axially extending elongated slot, an outer cylinder with an inner circumferential wall having a spiral groove and fitted rotatably around the outer periphery of said inner cylinder, and a payout cylinder having a peripheral projection and rotably mounted in said inner cylinder with said projection extending through said elongated slot of said inner cylinder and engaging said spiral groove of said outer cylinder and a bottomed rotary operating cylinder adapted to removably accommodate said cartridge, said rotary operating cylinder having a cylindrical elevation at its inner bottom, said inner cylinder of cartridge having a recess complementary to said cylindrical elevation for engagement at its outer bottom, said cylindrical elevation having a plurality of raised parts at circumferentially spaced intervals on its outer periphery for pressure contact with the inner circumferential surface of said recess, and said inner cylinder being circumferentially provided with linear resilient members on its outer periphery for contact with the inner circumferential surface of said outer cylinder.

In the cartridge type cosmetic bar container according to the present invention, the geometric relation between the rotary operating cylinder and the inner cylinder is the reverse of the conventional cartridge type container described hereinbefore, that is to say the outer bottom wall of said inner cylinder is provided with a recess which accepts an elevated part of the inner bottom of the rotary operating cylinder. Moreover, the outer peripheral surface of said inner cylinder is provided with resilient raised parts at circumferentially spaced intervals for pressure contact with the inner circumferential surface of said recess. As a result, the coupling of the rotary operating cylinder with the inner cylinder ca be accomplished by mere insertion of the lower part of the inner cylinder into the rotary operating cylinder, whereby the recess at the outer bottom of the inner cylinder is automatically and accurately engaged with the elevation at the inner bottom of the rotary operating cylinder. Therefore, unlike the conventional cartridge type cosmetic bar container, it does not happen that the torque of the rotary operating cylinder is not transmitted to the inner cylinder. Furthermore, since the outer peripheral surface of the inner cylinder in the present invention is circumferentially provided with linear resilient members for pressure contact with the inner circumferential surface of the outer cylinder, a frictional force is generated between said linear resilient members and the inner circumferential surface of the outer cylinder. Since this friction serves to be a resistance against the rotation of the inner cylinder in turning the rotary operating cylinder, an appropriate force is required for turning the operating cylinder, thus rather contributing to the ease of use of the container. Moreover, even if the bar-shaped cosmetic product such as a lipstick is paid out to an appropriate length of exposure and is pressed forcefully against the lip or the like in that condition, it does not happen that the cosmetic product is retracted down. Particularly as the lower part of the inner cylinder is provided with said linear resilient members, their positions are so close to the source of torque transmission to the inner cylinder that even if the linear resilient members are somewhat inclined, the inner cylinder is allowed to rotate smoothly. Furthermore, since the mechanism of coupling between said rotary operating cylinder and the lower part of the inner cylinder is simple in construction, the container can be easily manufactured at low cost. In addition, when the lower part of the payout cylinder is provided with cutouts in circumferentially spaced intervals and the projection engageable with the spiral groove of the outer cylinder is disposed in the remaining part of said lower part of the payout cylinder, dimensional errors of minor order can be well tolerated, for said projection is positioned in the resilient part. At the same time, since the above projection is allowed to engage with the spiral groove of the outer cylinder always in the proper condition, it becomes sufficient to provide only one projection and this means that the corresponding spiral groove of the outer cylinder and the elongated slot of the inner cylinder may also be one each, thus contributing further to the ease of manufacture.

BRIEF DESCRIPTION OF THE DRAWINGS

FIG. 2 (B) is a longitudinal section view showing its capped rotary operating cylinder;

DESCRIPTION OF THE PREFERRED EMBODIMENTS

The present invention is described below in further detail, reference being had to the accompanying drawings.

Figure 1:
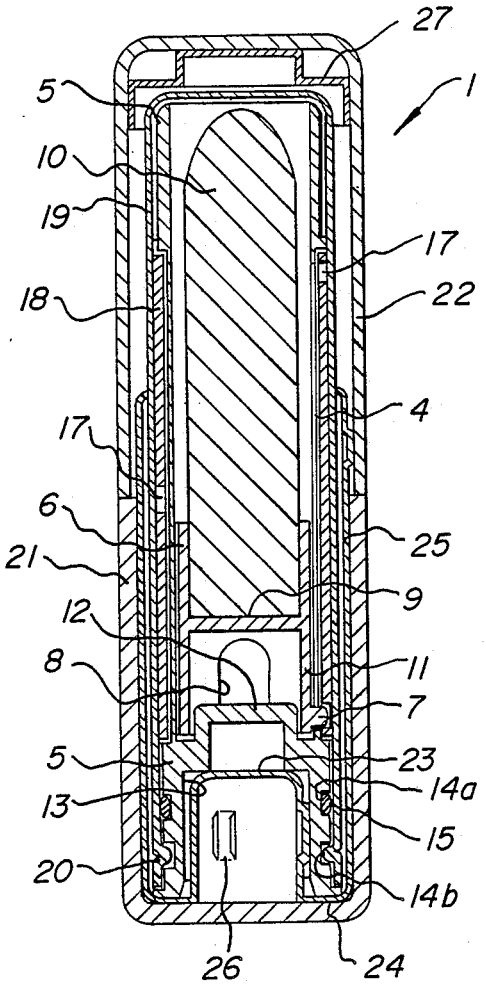
FIG. 1 is a longitudinal section view showing an embodiment of the invention.
Figure 2A:
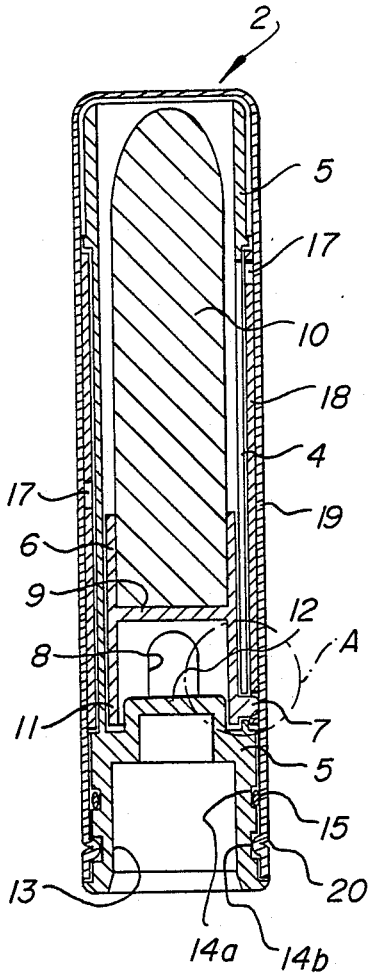
FIG. 2 (A) is a longitudinal section view showing its cartridge.
Figure 2B:
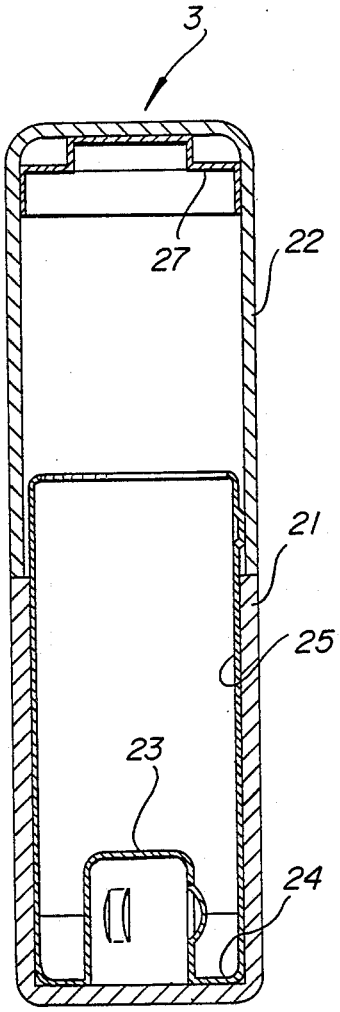

FIG. 1 is a sectional elevation view showing one preferred embodiment of the invention and FIG. 2 is a sectional elevation view showing a cartridge taken out from a capped rotary operating cylinder. In these views, the reference numeral 1 designates a cartridge type cosmetic bar container according to the invention, which comprises a cartridge 2 and a capped rotary operating cylinder 3 for removably accommodating said cartridge container.

Figure 3:
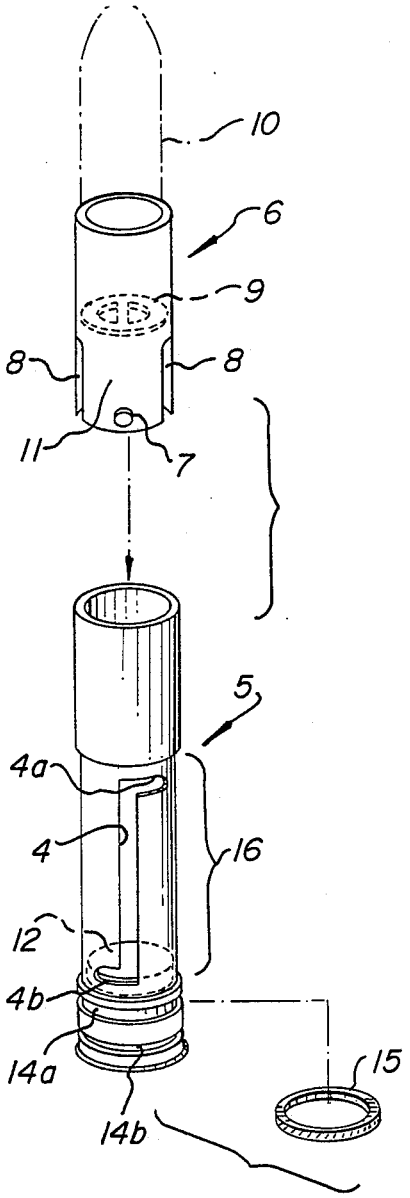
FIGS. 3, 4 and 5 are assembling diagrams for said cartridge.
Figure 4:
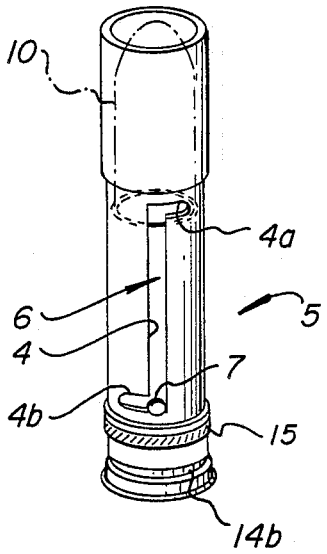
Figure 5:
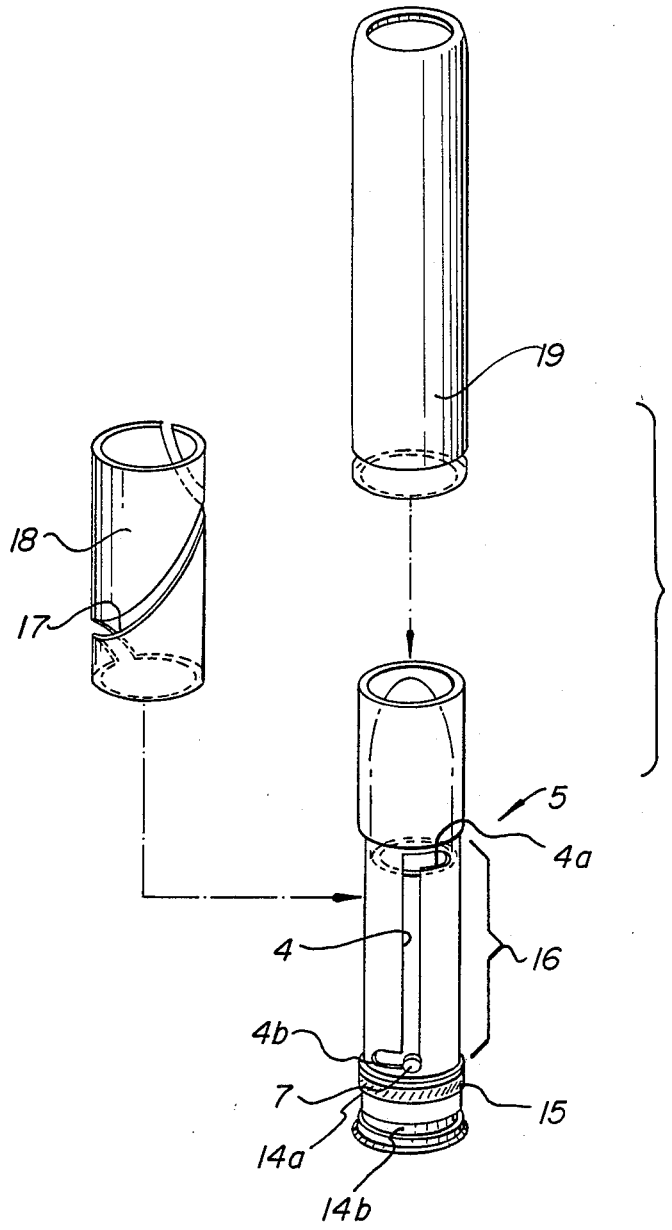

As illustrated in FIG. 2 (A), said cartridge 2 comprises a bottomed plastic inner cylinder 5, a bottomed plastic payout cylinder 6 accommodated in said inner cylinder in vertically movable relation, a metal outer cylinder 19 in which said inner cylinder 5 is rotatably accommodated, and a metal cylindrical element 18 integrally connected to said outer cylinder. As illustrated in FIG. 3, said inner cylinder 5 is formed with a step 16 in an intermediate part thereof, the wall of which is formed with an axially extending elongated slot 4. The bottom of the inner cylinder 5 is situated at a slightly elevated level with respect to the bottom edge of the peripheral wall of the inner cylinder 5 and is centrally formed with a cylindrical elevation 12. There is an air space between the outer peripheral surface of said elevation 12 and the inner circumferential surface of the inner cylinder 5. Furthermore, a recess 13 is defined by the bottom and surrounding part of the inner cylinder 5. The outer peripheral surface of the inner cylinder 5 at its lower part is circumferentially formed with two grooves 14*a*, 14*b* and a rubber O-ring 15 is snapped in the top groove 14*a*. The payout cylinder 6 has a bottom plate 9 at a slight elevation from the bottom edge of its peripheral wall and a lipstick is held in position by this bottom plate 9 and the surrounding part of the peripheral wall. The lower part of the payout cylinder 6 is formed with two arch-shaped cutouts 8, with the remaining part constituting a semicircular portion 11. This semicircular portion 11 is resiliently inwardly deformable and, when the payout cylinder descends, enters into the gap between the outer peripheral surface of the elevation 12 and the inner circumferential surface of the inner cylinder 5. The outer peripheral surface of this semicircular portion 11 is formed with a projection 7 engageable with the elongated slot 4 of the inner cylinder 5. As illustrated in FIG. 4, said payout cylinder 6 is inserted into the inner cylinder 5 in vertically movable relation and its projection 7 is engaged with the elongated slot 4 of the inner cylinder 5. In this condition, the free end of the projection 7 extends beyond the elongated slot 4. In other words, the forward end of the projection 7 extends through the elongated slot 4. As shown in FIG. 5, the outer cylinder 19 is slightly larger in diameter than the inner cylinder 5 and is fitted over the outer periphery of the inner cylinder 5. In this condition, the inner cylinder 5 is rotatable with respect to the outer cylinder 19. Referring to FIG. 2 (A), the reference numeral 20 indicates a ridge formed circumferentially in the lower part of the outer cylinder 19 and is rotatably engaged by the groove 14*b* formed in the outer peripheral surface of the inner cylinder 5 at its lower part so as to join the two cylinders 5 and 19 together. The reference numeral 18 indicates a cylindrical element set in position within the clearance between the step of inner cylinder 5 and the outer cylinder 19 and, as shown in FIG. 5, its peripheral wall is formed with a spiral elongated slot 17. By this formation of spiral elongated slot 17, the cylindrical element 18 appears as if a band-shaped material were spirally wound up to form a cylinder. It is substantially equal to the outer cylinder 19 in diameter and as positioned in said gap, it is in intimate contact with the inner circumferential surface of the outer cylinder 19 to provide an integral unit. By the above arrangement, the spiral elongated slot 17 of the cylindrical element 18 constitutes a spiral groove 17, the bottom of which is the inner circumferential surface of the outer cylinder 19. The free end of said projection 7 of the outer periphery of the payout cylinder 6 is engaged with said spiral groove 17 after passing through- the elongated slot 4 of the inner cylinder 5. As a result, when the inner cylinder 5 is rotated with respect to the outer cylinder 19, the point of intersection of the spiral groove 17 of the outer cylinder 19 with the elongated slot 4 of the inner cylinder 5 is moved up or down. Since the projection 7 is engaged by both of said spiral groove 17 and elongated slot 4, it is naturally positioned at the point of intersection and follows the vertical movement of the point of intersection. As a result, the payout cylinder 6 having said projection 7 is driven vertically (up and down).

Figure 7:
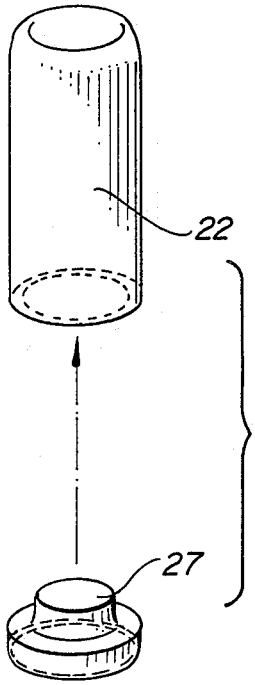
FIGS. 6 and 7 are assembling diagrams for said capped rotary operating cylinder.
Figure 6:
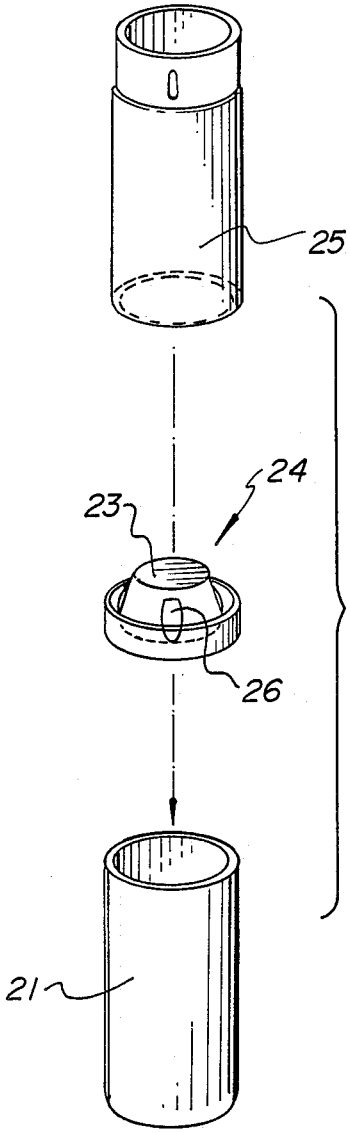

The capped rotary operating cylinder 3 illustrated in FIG. 2 (B) comprises a metal rotary operating cylinder 21 and a metal cap body 22. As illustrated in FIG. 6, a flat-bottomed dish-shaped metal element 24 with a central cylindrical elevation 23 is securely pressed into the inner bottom of said metal rotary operating cylinder 21 and an intermediate metal cylinder 25 is securely fitted on top thereof. The top of the intermediate cylinder 25 has means for removably accepting said cap body 22. Furthermore, the outer peripheral surface of said cylindrical elevation 23 is circumferentially provided with three spring members 26 formed by making incisions into the outside wall thereof and raising the parts of incision outwards. As illustrated in FIG. 1, with the cartridge 1 being acccmmodated in the capped rotary operating cylinder 3, said cylindrical elevation 23 is fitted into the recess 13 at the outer bottom of the inner cylinder 5 and secured in position by the resilient action of the spring members 26, whereby the rotary operating cylinder 3 and inner cylinder 5 are interconnected as a unit. As shown in FIG. 7, a dish-shaped metal element 27 with a stepped bottom is inserted into the ceiling portion of said cap body 22. In the transport of the cartridge type cosmetic bar container in the condition illustrated in FIG. 1, for instance, the above dishshaped element 27 serves to receive the top end of the cartridge 2 and prevent slipping of the cartridge out of the cylindrical element 23 of the rotary operating cylinder 21 when the whole container is dropped in an inverted position.

In the above construction, when the container is not used, the rotary operating cylinder 3 is manipulated to lower the payout cylinder 6 and the projection 7 is set in the horizontal slot 4*b* (FIG. 4) at the bottom end of the elongated slot 4 so that the payout cylinder 6 will not be paid out unintentionally. When the container is to be used, the cap body 22 of the capped rotary operating cylinder 3 is first released from the condition shown in FIG. 1 and the metal rotary operating cylinder 21 is rotated in one direction. This torque is transmitted to the inner cylinder 5 through the cylindrical elevation 23 at the inner bottom of the rotary operating cylinder 21 and the recess 13 of the inner cylinder 5 so that the inner cylinder 5 is rotated in one direction relative to the outer cylinder 19. As a result, the payout cylinder 6 ascends along the elongated slot 4 and the lipstick 10 projects out from the top openings of the inner cylinder 5 and outer cylinder 19 for ready use. Since, in this condition, the projection 7 of the payout cylinder 6 is located in the horizontal slot 4a at the top end of the elongated slot 4, even pressing the lipstick 10 hard against the lip does not cause the lipstick 10 to descend along with the payout cylinder 6. Particularly in this embodiment wherein the outer periphery of the lower part of the inner cylinder 5 is fitted with a rubber O-ring which is in intimate contact with the inner circumferential surface of the outer cylinder 19, there is the advantage that even if the lipstick 10 is pressed against the lip with the projection 7 of the payout cylinder 6 being situated partway along the elongated slot 4, the lipstick 10 does not descend unless it is pressed with more than usual force. Therefore, it is possible to use the lipstick 10 in a suitable position without causing it to ascend or project as far as it goes. To retract the lipstick 10 back into the container, the payout cylinder 6 is rotated in the reverse direction. For changing the cartridge 2, the current cartridge 2 is pulled up, with the cap body 22 having been removed. Thereupon, the recess 13 at the bottom of the inner cylinder 5 is slipped out from the cylindrical elevation 23 of the rotary operating cylinder 21, thus permitting removal of the cartridge 2. Then, a fresh cartridge 2 is installed in the rotary operating cylinder 21 and the bottom recess of the inner cylinder 5 of the fresh cartridge 2 is fitted to the cylindrical elevation 23, whereupon the fresh cartridge 2 is firmly set in position.

Figure 8:
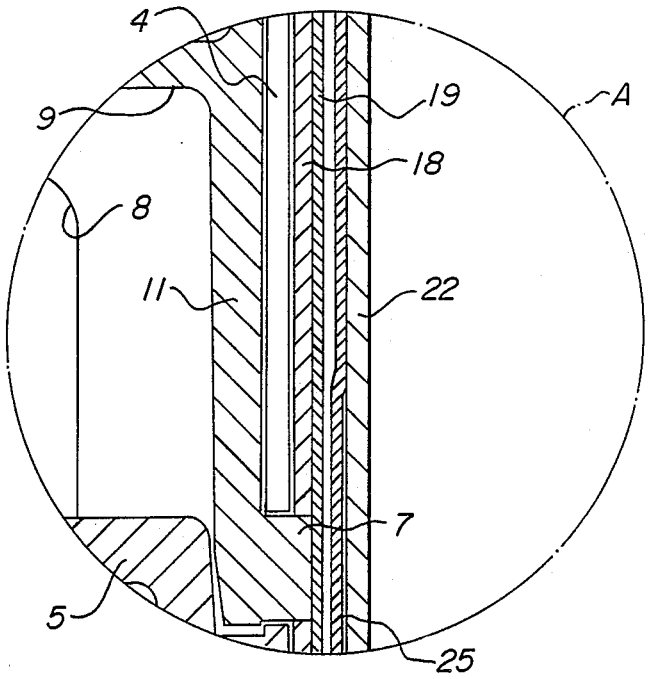
FIG. 8 is a longitudinal section view showing a cardinal part (the part corresponding to the part enclosed by a circle in FIG. 2 (A)) of another embodiment.
Figure 9:
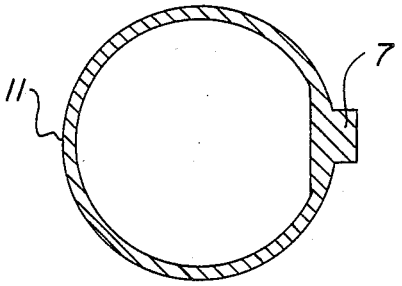
FIG. 9 is a transverse section view thereof.
Figure 10:
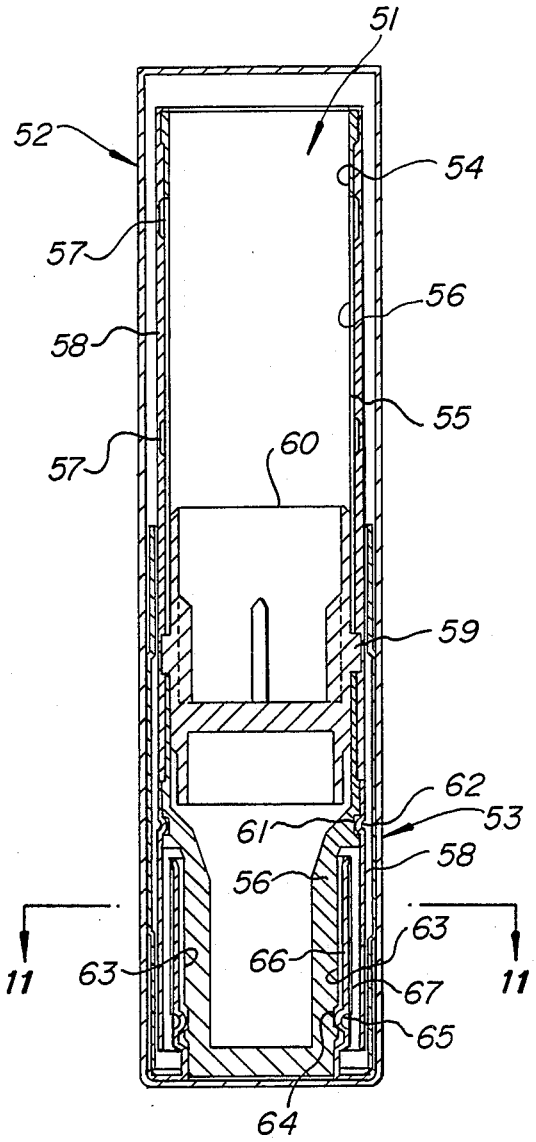
FIG. 10 PRIOR ART
FIG. 10 is a longitudinal section view showing the conventional container.
Figure 11:
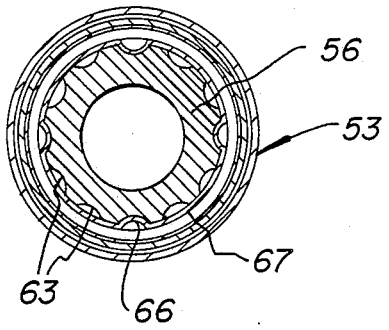
FIG. 11 PRIOR ART
FIG. 11 is a sectional view taken along the line A—A' of FIG. 10.
Figure 12:
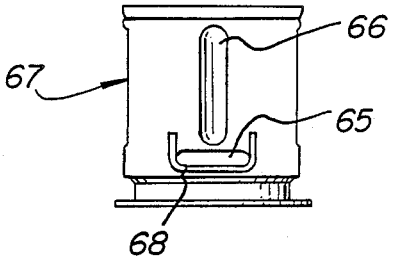
FIG. 12 PRIOR ART
FIG. 12 is a front view showing a built-in cylinder used in the conventional container.

When the part of the payout cylinder 6 where the projection 7 is formed is thicker than the remaining part for added strength as illustrated in FIGS. 8 and 9, it is less liable to crack and, hence, contributes to an extended useful life of the cartridge type cosmetic bar container. Furthermore, when the inner circumferential surface of the metal cylinder 18 is clad with a resin film, the burs formed at the end and spiral slot 17 of the cylinder 18 are covered up with the resin film to improve the slidability between the cylinder 18 and the plastic inner cylinder 5 contacting its inner circumferential surface in turning the rotary operating cylinder 3, whereby the foreign sensation due to abnormal friction due to the burs is eliminated. Such a metal cylinder 18 clad with a resin film can be obtained by coating one side of a thin metal sheet with a synthetic resin coating composition or laminating one side of a thin metal sheet with a synthetic resin sheet, then punching the coated metal sheet or metal-resin laminate and rolling the punched-out sheet. It should be understood that the above-mentioned resin film may be provided not only on the inner circumferential surface but also on the outer peripheral surface of the cylinder 18. By so doing, the intimacy of contact between the cylinder 18 and outer cylinder 19 can be further increased.

What is claimed is:

1. A cartridge type cosmetic bar container which comprises a cartridge comprising a bottomed inner cylinder with a peripheral wall having an axially extending elongated slot, an outer cylinder with an inner circumferential wall having a spiral groove and fitted rotatably around the outer periphery of said inner cylinder, and a payout cylinder having a peripheral projection and rotatably mounted in said inner cylinder with said projection extending through said elongated slot of said inner cylinder and engaging said spiral groove of said outer cylinder and a bottomed rotary operating cylinder adapted to removably accommodate said cartridge, said rotary operating cylinder having a cylindrical elevation at its inner bottom, said inner cylinder of said cartridge having a recess complementary to said cylindrical elevation for engagement at its outer bottom, said cylindrical elevation having a plurality of raised parts at circumferentially spaced intervals on its outer periphery for pressure contact with the inner circumferential surface of said recess, and said inner cylinder being circumferentially provided with linear resilient members on its outer periphery for contact with the inner circumferential surface of said outer cylinder.

2. The cartridge type cosmetic bar container of claim 1 wherein said linear resilient members are disposed on the outer peripheral surface of a lower part of said inner cylinder.

3. The cartridge type cosmetic bar container of claim 1 wherein a lower part of said payout cylinder is circumferentially cut out at predetermined intervals and said projection thereof for engaging said spiral groove of said outer cylinder is disposed in the remaining part of said lower part of the payout cylinder.

* * * * *